United States Patent [19]

Wilson

[11] Patent Number: 4,533,200

[45] Date of Patent: Aug. 6, 1985

[54] STACKABLE ELECTRICAL CONNECTOR

[75] Inventor: Albert H. Wilson, Los Angeles, Calif.

[73] Assignee: Thomas & Betts Corporation, Raritan, N.J.

[21] Appl. No.: 391,211

[22] Filed: Jun. 23, 1982

[51] Int. Cl.[3] ..... H01R 4/02

[52] U.S. Cl. ..... 339/99 R; 339/176 MF; 339/221 M

[58] Field of Search ..... 339/97 R, 97 P, 99 R, 339/221 M, 276 A, 176 MF, 174

[56] References Cited

U.S. PATENT DOCUMENTS

| | | | |
|---|---|---|---|
| 2,977,562 | 3/1961 | Benson | 339/47 R X |
| 3,403,372 | 9/1968 | Stinson, Jr. | 339/97 |
| 3,444,506 | 5/1969 | Wedekind | 339/99 R |
| 3,820,058 | 6/1974 | Friend | 339/99 R |
| 3,824,527 | 7/1974 | Evans | 339/97 |
| 3,840,840 | 10/1974 | Worth | 339/99 R |
| 3,897,128 | 7/1975 | Reavis, Jr. | 339/97 R X |
| 3,923,361 | 12/1975 | Rosen | 339/47 |
| 3,950,065 | 4/1976 | Renn | 339/98 |
| 4,036,544 | 7/1977 | Keglewitsch | 339/91 R |
| 4,106,838 | 8/1978 | Jayne et al. | 339/99 |
| 4,118,096 | 10/1978 | Takahashi | 339/99 R |
| 4,141,618 | 2/1979 | Reavis, Jr. et al. | 339/97 |
| 4,149,764 | 4/1979 | Mattingly, Jr. | 339/17 |
| 4,162,815 | 7/1979 | Fleischhacker | 339/19 |
| 4,209,219 | 6/1980 | Proietto | 339/99 R |
| 4,252,397 | 2/1981 | Elgenbrode | 339/99 R |
| 4,283,105 | 8/1981 | Perrill et al. | 339/97 R |
| 4,351,582 | 9/1982 | Emerson et al. | 339/97 R X |
| 4,386,820 | 6/1983 | Dola | 339/99 R X |
| 4,410,222 | 10/1983 | Enomoto | 339/99 R X |
| 4,410,229 | 10/1983 | Stephenson | 339/99 R X |

*Primary Examiner*—William R. Briggs

*Attorney, Agent, or Firm*—Robert M. Rodrick; Salvatore J. Abbruzzese

[57] ABSTRACT

An electrical connector for stacking over a printed circuit board or other electronic component. The connector which electrically connects flat cable, includes a plurality of insulation displacing contacts, each having a socket portion capable of receiving a further contact stacked thereover, and an insertion portion for insertion into a further contact, printed circuit board or other electronic component.

12 Claims, 7 Drawing Figures

STACKABLE ELECTRICAL CONNECTOR

FIELD OF THE INVENTION

This invention relates to the field of electrical connectors and more particularly to a hermaphroditic contact connector for stacking over an electronic component.

BACKGROUND OF THE INVENTION

In the field of connecting devices, connectors are employed to connect conductor cable to other electronic components such as printed circuit boards, cards, plugs and the like. Components such as dual-in-line plugs (DIP) are commonly used to electrically and mechanically terminate and connect flat cable to printed circuit boards. These DIP plugs, which typically include a cover, base and a plurality of insulation-displacing contacts carried in the cover or base, are inserted into the printed circuit boards to establish connection. Due to space limitations inherent in printed circuit boards, it is often necessary when connecting a plurality of conductor cables, to place the connectors in close proximity over the printed circuit board. It is desirable not only to connect the cable to the printed circuit board, but also to connect one cable to another.

The prior art has seen vertical stacking of various electronic components. Most of these components are mechanically stacked and rely on separate contact members which extend vertically to electrically connect the stacked components. Often it is necessary to employ a plurality of these contact members to connect one component to the next succeeding component. Further, when employing contact members for electrical connection between stacked components, it is common to employ a housing to securely retain the components and contact member. One type of stackable flat cable connector is described in U.S. Pat. No. 4,106,838 wherein the connector body houses a plurality of insulation displacing contacts. These contacts include a central hollow body for receiving contact pins from above and below. An offset insulation displacing member extends laterally and downwardly from the central body and pierces the flat cable and electrically contacts the conductor. As above mentioned, these connectors require separate contact portions to make stackable connections.

Vertical stacking of printed circuit boards and the like is shown in U.S. Pat. Nos. 3,923,361 and 4,149,764. However, these patents do not provide for interconnection between cable connectors.

SUMMARY OF THE INVENTION

The present invention has as an object to provide an electrical contact connector which will connect to a conductor cable and can be inserted into a printed circuit board or a further hermaphroditic connector and is capable of receiving in electrical connection a further electrical contact.

It is a further object to provide an electrical insulation displacing contact which retains the conductor therein.

In the attainment of the foregoing and other objects, the present invention in its preferred form includes a connector body including a plurality of hermaphroditic contacts. Each contact electrically connects to a conductor on the conductor cable. In the preferred embodiment the contact comprises an upper socket portion which is capable of receiving a contact of a further hermaphroditic connector and a tail portion which may be inserted into a further hermaphroditic connector or other electronic component such as a printed circuit board.

Other objects and features of the invention will be evident from the following detailed description of the preferred embodiments.

DETAILED DESCRIPTION OF PREFERRED EMBODIMENTS

Figure 1:
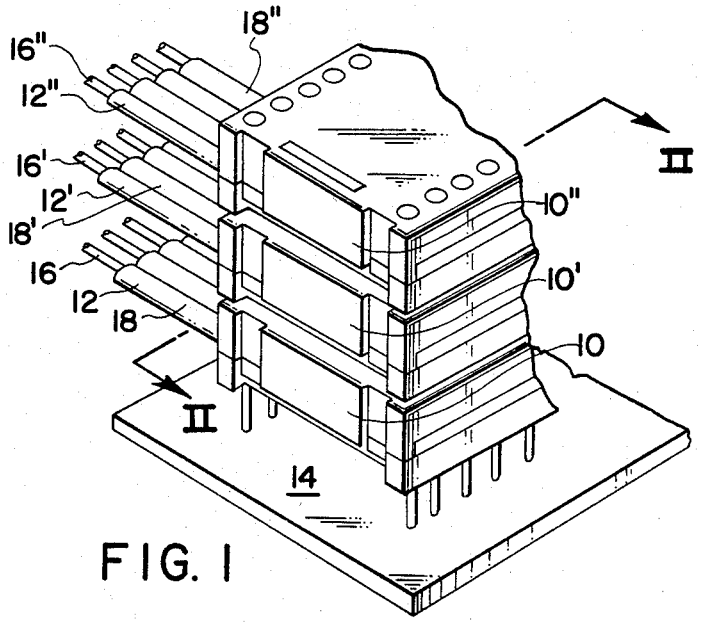
FIG. 1 shows in perspective, three hermaphroditic contact connectors of the present invention partially fragmented and connected to flat cable for stacking over a printed circuit board.
Figure 2:
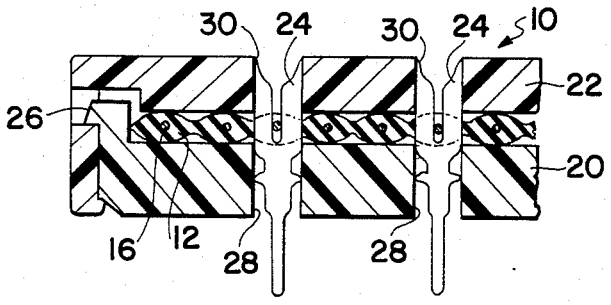
FIG. 2 shows in detail the cross-section of one of the hermaphroditic connectors of FIG. 1 as viewed along section line II—II thereof.

Referring to FIGS. 1 and 2, there is shown connectors 10, 10' and 10" vertically stacked in accordance with the present invention, connecting flat cable 12, 12' and 12" to a printed circuit board 14. Flat cables 12, 12' and 12" are conventional and comprise a number of individual conductors 16, 16', 16" (respectively), which may have a round, square, rectangular or any other desirable cross-sectional shape. These conductors are surrounded by insulation 18, 18', 18" (respectively), which provides the presently shown flat form.

As connector 10 is identical to connectors 10' and 10", similar reference numerals will be used to denote like elements. For simplification of description, reference will be made to connector 10, shown immediately over and adjacent printed circuit board 14.

Connector 10, shown in detail in FIG. 2, comprises a base member 20, a top cover 22 and a series of hermaphroditic contacts 24. A latch, snap or other conventional locking type mechanism 26 is employed to secure top cover 22 to base 20, holding therebetween flat cable 12 in intimate contact with contacts 24, as will be described hereinafter.

Base member 20 being generally in the shape of a flat plate, includes a series of cylindrical openings 28, extending from top to bottom for receiving a central portion of contacts 24. Openings 28 are arranged in two columns along each marginal longitudinal edge of base 20, so that one opening will lie directly below a conductor 16 of flat cable 12 when properly positioned. In preferred form, one row of openings will be positioned over every other conductor, while the second row of openings will correspond to the remaining conductors.

Cover 22, which is also generally in the shape of a flat plate, is suitably secured over the base member 20 with flat cable 12 lying therebetween. Cover 22 includes a series of openings 30 extending therethrough which correspond to openings 28 of base member 20 and receive an upper extent of contact 24, once the contacts have passed through cable 12, as will be described hereinafter.

Figure 3:
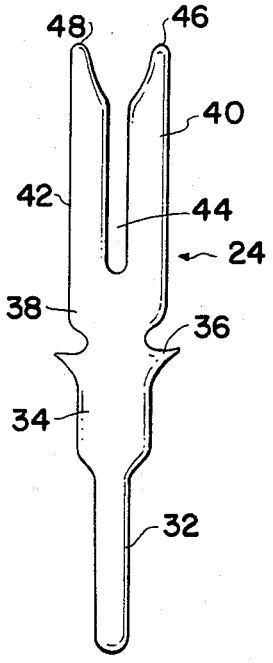
FIG. 3 shows an elevation view of the hermaphroditic contact of the connector of the present invention.

The individual contacts 24, shown in detail in FIG. 3, are seated in openings 28 of base member 20, and constitute insulation displacing contacts which will pierce the insulation 18 and electrically engage the conductors 16 of cable 12. Contacts 24 of the present invention are similar to the contacts which are shown and described in U.S. Pat. No. 3,964,816, issued June 22, 1976 and assigned to the assignee of the present invention.

Figure 4:
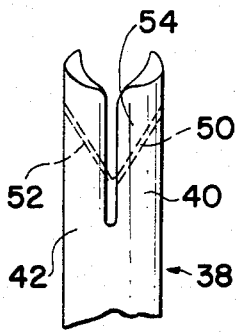
FIGS. 4, 5 and 6 are alternative embodiments of the contact of FIG. 3, FIG. 4 being partially fragmented.

Contact 24 includes a tail portion 32 which extends below the bottom surface of base member 20 when contact 24 is seated in connector 10. Tail portion 32 is insertable into a further electronic component such as an opening in a printed circuit board or into the socket portion of a further hermaphroditic contact as will be described hereinafter. A central portion 34 of contact 24 secures the contact in opening 28 of base member 20. An annular lip 36 is included on central portion 34 so that the contact 24 can be press fit into opening 28 for secure engagement. Above central portion 34, a socket portion 38 extends upwardly past the upper surface of base member 20. Socket portion 38 includes a pair of upstanding arms 40 and 42 which define between them a pair of diametrically opposed longitudinally extending slots 44. Each of the upstanding arms 40 and 42 includes an upper tapered portion which terminates in sharpened tips 46 and 48 respectively, which are capable of piercing the insulation 18 of cable 20 to thereby position the individual conductors 16 over slots 44. Slots 44 may have a wider diameter near the upper edge than at its lower extent so as to readily accept conductor 16 of cable 20, as will be described hereinafter. As socket member 38 extends above the upper surface of base member 20, the flat cable 12 can be aligned so that one conductor 16 lies over each socket member 24. Cover 22 may then be inserted over base 20 so that upon application of force upon cover 22, the individual conductors of flat cable 20 are forced down into slots 44 of contact 24, establishing electrical connection therebetween. The sharpened points 46 and 48 pierce the insulation 10 of flat cable 20 and the tapered portion of upstanding arms 40 and 42 guide conductors 16 into slots 46. Cover 22 then snaps or locks into place over base 20 by means of suitable crimping tools or the like, so that upwardly extending socket portion 38 of contact 24 will be accepted in openings 30 of cover 22. In this position, socket member 38 is in communication with the upper extent of opening 30 of cover 22 and can accept a tail portion of a further hermaphroditic contact. In order to receive such a tail portion, socket portion 38 may include resilient side walls 50 and 52 adjacent upstanding arms 40 and 42 (shown in detail in FIG. 4) which are inwardly lanced and indented so as to provide a tapered chamber 54. Also shown in FIG. 7, with tail portion 32' inserted therein, the chamber 54 narrows at its lower end to a diameter smaller than that of the tail portion so that upon insertion, the side walls 50 and 52 will be forced apart, thereby insuring secure mechanical and electrical connection between the contacts. Additionally, the resilient walls 50 and 52 may be modified to serve as a retainer to secure the inserted conductor therein. By extending the indented ends of walls 50 and 52 so that they are nearly adjacent, the conductor can be forced below the ends of the walls which will then flex back over the conductor so as to lock the conductor therein.

Figure 5:
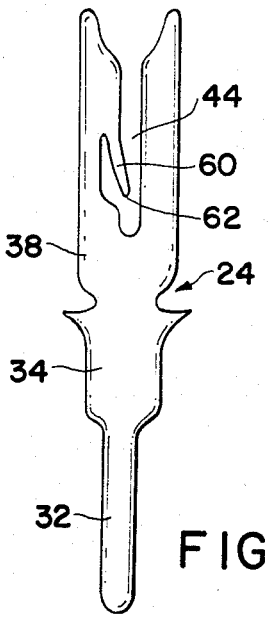
Figure 7:
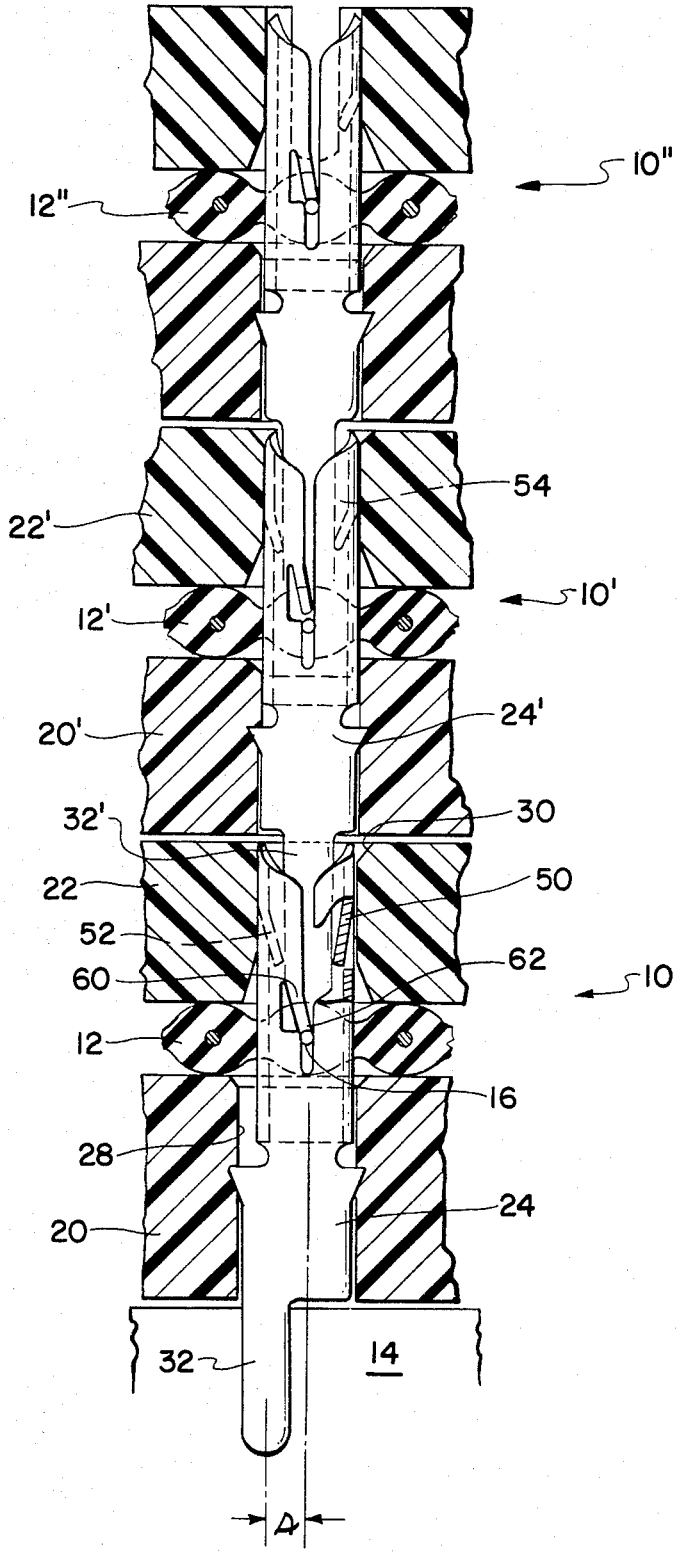
FIG. 7 is a sectional showing of the assembled connector and cable structure in stacked form.

A modification of the contact of the present invention is shown in FIG. 5. Contact 24 is modified at its socket portion 38, to include a centrally located, deflectable conductor retaining barb 60 along slot 44. The barb 60 is formed from the upstanding wall 42, adjacent slot 44 and extends into the main channel of the slot. As the conductor is forced down into slot 44, the spring-like barb 60 will deflect away to allow the conductor to pass. When conductor 16 has passed the distal edge 62 of barb 60, the barb will flex back over the inserted conductor to prevent withdrawal. The edge 62 of barb 60 will lock against the inserted conductor and further provide electrical connection and mechanical securement. As shown in FIG. 7, barb 60 acts as a one-way flap allowing conductor 16 to pass downwardly through slot 60, but preventing upward withdrawal. As with the extended resilient side walls shown in FIG. 4, barb 60 flexes over the inserted conductor so as to lock the conductor therein.

Figure 6:
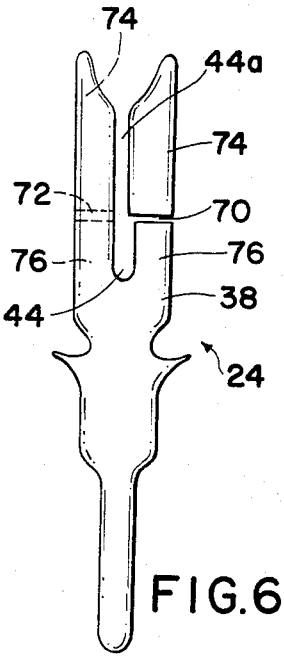

A still further modification of the contact is contemplated for providing another means to lock the conductor 16 in slot 44 for superior mechanical securement and electrical connection. FIG. 6 shows contact 24, including along its socket portion 38, a pair of transverse slits 70 and 72 which communicate with slot 44. Slits 70 and 72 each extend from opposite edges of the respective upstanding arms 42 and 44. Slits 70 and 72 extend a quarter way around and through the circumference of the pair of upstanding arms to form resiliently bendable upper sections 74 and fixed lower sections 76. Each of the upper sections 74 immediately above slits 70 and 72 are deformed to present a reduced diameter and thereby a narrower slot 44A of the upper section 74 than at the lower section 76. Upon insertion of a conductor 16 from above the upper sections 74 will deflect oppositely outward to allow passage of the conductor 16. Upon full insertion of the conductor 16, each of the deformed upper sections 74 will then flex back over the inserted conductor 16 to securely retain the conductor therein in electrical connection. Again, as with the previously described embodiments, this retention feature serves to secure the conductor in contact 24.

FIG. 7 shows partly in section, a portion of connectors 10, 10' and 10'' stacked vertically over printed circuit board 14 and connecting flat cable 12, 12' and 12'' respectively.

Connector 10 is shown having base member 20 over printed circuit board 14. Contact 24, as shown in FIG. 7 also serves as a transition contact which makes the transition between a 0.100 inch×0.100 inch square pitch grid socket to a 0.100 inch×0.100 inch pitch with a 0.050 inch stagger between rows, the tail portion 32 being offset from the center of the socket portion 38 by an amount s. It is also within the contemplation of the present invention to provide contacts which may have socket portions at a first pitch and insertions spaced at a second pitch different from the first such that a transition may be made from a cable conductor pitch of 0.050 inch spacing to a PCB socket spacing of 0.100 inch. The contacts 24 are shown seated in openings 28 of base 20 having tail portions 32 which are inserted into appropriate openings in the printed circuit board 14. Cable 12 is shown secured between base member 20 and cover 22, in an electrically connected position. Conductor 16 is seated in the lower end of slot 44, the insulation 18 having been displaced by upstanding arms 40 and 42. The conductor 16 is seated below edge 62 of barb 60 which secures its position in socket 38. Cover 22 is disposed over cable 12 and is snapped or otherwise suitably secured to base member 20. Each opening 30 of cover 22 receives the socket portion 38 of each contact 24 which are in communication with the exterior of cover 22. Mounted thereover is connector 10' which includes contacts 24', the tail portions 32' of which extends down from base 20'. As with connector 10, connector 10' is connected to flat cable 12', in a manner described hereinabove. Connector 10' is vertically stacked over connector 10, with a tail portion 32' of connector 10' inserted into a socket portion 38 of connector 10. As described above, side walls 50 and 52 of socket 38 receive tail portion 32' so as to mechanically and electrically connect connector 10 to connector 10'.

A further similar connection is shown between connector 10' and 10'' which will also be electrically connected to connector 10. While only three connectors are shown in the present embodiment, it is well within the contemplation of the present invention to vertically stack any number of connectors and associated cables.

Accordingly, the above-described embodiments are shown only by way of example and are in no sense limited to the particularly described features. The true spirit and scope of the invention are set forth in the claims appended hereto.

What is claimed is:

1. An electrical connector for insulated conductor cable comprising:

a housing;

a contact mounted in said housing, said contact including a socket portion opening exteriorly of said housing, and an insertion portion extending exteriorly of a surface of said housing; said socket portion having a receiving slot including means for electrically engaging said contact to a conductor of said cable said socket defining a chamber in communication with said slot, tapering toward said inserting portion, said chamber adapted to receive a conductive element therein.

2. The connector in accordance with claim 1 wherein said slot defines an insulation displacing member for piercing the insulation and contacting the conductor of said cable.

3. The connector in accordance with claim 2 wherein said socket portion includes means for retentively holding said conductor.

4. The connector in accordance with claim 3 wherein said retentive holding means includes a deflectable retaining barb extending from said insulation displacing member.

5. The connector in accordance with claim 2 wherein said socket portion defines a tubular body.

6. The connector in accordance with claim 5 wherein said slot is tapered, having a larger access adjacent said insulation displacing members.

7. The connector in accordance with claim 6 wherein said body includes a slit substantially perpendicular to said slot; said slit dividing said tubular body into upper and lower sections, said upper section being deformable with respect to said lower section to deflect for passage of said conductor and to securely retain said conductor in said lower section.

8. A stackable connector assembly for electrically connecting insulated flat cable having a plurality of parallel conductors, said assembly comprising:

a base;

a cover, said base and cover adapted to receive said cable therebetween;

each of said base and said cover having a plurality of contact receiving openings therethrough, said openings being arranged in a predetermined pattern, each of said cover openings being aligned in registry with one of said base openings for selective alignment with successive conductors of said cable; and contacts mounted in said base openings, each of said contacts having a socket portion for receipt of a conductive element therein, said socket portion extending in communication with said aligned cover openings, said contact socket portion including insulation displacing members for piercing the insulation and contacting the conductors of said cable, each said contact further including an insertion portion extending opposite said socket portion and beyond said base opening.

9. The connector assembly in accordance with claim 8 wherein said contacts are mounted such that said socket portions are arranged at a first pitch and said insertion portions are arranged at a second pitch, different from said first pitch.

10. The connector assembly in accordance with claim 8 wherein said contact insertion portions are staggered with respect to said socket portions.

11. The connector assembly in accordance with claim 8 wherein said contact socket portion includes means for retentively receiving said conductor of said cable therein.

12. The connector in accordance with claim 5 wherein said tubular body includes a pair of resilient side walls lanced therefrom, said side walls defining said tapered chamber.

* * * * *